US005997156A

United States Patent [19]

Perlo et al.

[11] Patent Number: 5,997,156

[45] Date of Patent: Dec. 7, 1999

[54] LIGHTING DEVICE FOR GENERATING A RECTANGULAR PATTERN AT THE WORK AREA, E. G. FOR ILLUMINATING PEDESTRIAN CROSSINGS

[75] Inventors: Piero Perlo, Sommariva Bosco; Claudia Bigliati, Trino; Vito Lambertini, Giaveno; Piermario Repetto, Turin; Sabino Sinesi, Piossasco, all of Italy

[73] Assignee: C.R.F. Societa Consortile per Azioni, Orbassano, Italy

[21] Appl. No.: 08/985,269

[22] Filed: Dec. 4, 1997

[30] Foreign Application Priority Data

Dec. 5, 1996 [IT] Italy ..... TO96A0988

[51] Int. Cl.[6] ..... F21V 5/00

[52] U.S. Cl. ..... 362/328; 362/335; 362/337

[58] Field of Search ..... 362/328, 329, 362/333, 335, 337, 339

[56] References Cited

U.S. PATENT DOCUMENTS

| | | | |
|---|---|---|---|
| 2,551,954 | 5/1951 | Lehman | 362/328 |
| 3,735,124 | 5/1973 | Stahlhut | 362/326 |
| 5,521,725 | 5/1996 | Beeson | 359/40 |
| 5,600,455 | 2/1997 | Ishikawa | 349/57 |
| 5,676,453 | 10/1997 | Parkyn | 362/260 |

*Primary Examiner*—Sandra O'Shea
*Assistant Examiner*—Marshall Honeyman
*Attorney, Agent, or Firm*—Sughrue, Mion, Zinn, Macpeak & Seas, PLLC

[57] ABSTRACT

A lighting device which can be used for illuminating pedestrian crossings or in other applications where it is necessary to form a defined and uniform rectangular pattern includes a parabolic reflector element and a planar screen with an array of cylindrical microlenses or microprisms on a surface thereof.

3 Claims, 3 Drawing Sheets

LIGHTING DEVICE FOR GENERATING A RECTANGULAR PATTERN AT THE WORK AREA, E. G. FOR ILLUMINATING PEDESTRIAN CROSSINGS

BACKGROUND OF THE INVENTION

The present invention relates to a lighting device able to generate a light beam which forms a defined and uniform rectangular pattern at the work area, e.g. for illuminating pedestrian crossings or for use in other applications where an illumination pattern of the above indicated type is required, such as in the case of motor-vehicle fog lamps, or for illuminating paintings or long aisles in industrial buildings, etc.

The object of the present invention is that of providing a device of the above indicated type which is able to form a rectangular pattern of relatively wide dimensions starting from a device of reduced dimensions, which may have any shape, including the circular shape, and with a relatively simple and inexpensive structure.

SUMMARY OF THE INVENTION

In order to achieve this object, the invention provides a lighting device of the above indicated type, characterized in that it comprises:

a light source, a reflector element for reflecting the light rays emitted by the light source towards an area to be illuminated, and a screen located in front of the reflector and having either one or both faces with an array of cylindrical microlenses.

The cylindrical microlenses are distributed according to a pitch comprised between 0.1 millimetres and 0.5 millimetres, preferably of 0.2 millimetres. This pitch value indeed insures a better uniformity of illumination without inducing the technological difficulties which would be associated with a smaller pitch. Greater pitches instead involve a reduction of uniformity of the beam.

According to a further feature of the invention, the cylindrical microlenses have a value of the so-called "F number", i.e. the ratio of the focal length to the lens width, which is very low, preferably close to 1.

In a variant, the array of cylindrical microlenses is replaced by an array of microlenses still characterized by a cylindrical symmetry but with a general aspherical profile; the aspherical profile is optimized to ensure an uniform illumination inside the rectangle. In order to make the fabrication easier and to minimize scattering effects due to the fabrication errors, the aspherical profile can be of a substantially sinusoidal type ensuring the first derivative continuity between two adjoining microlenses.

In a second variant, the array of cylindrical microlenses is replaced by an array of Total Inner Reflection (TIR) microprisms. It is possible to provide a symmetrical array of microprisms at the right and the left of the median axis of the device. All the said arrangements are chosen as a function of the need to insure the uniformity of the beam in the work plane. The TIR prisms, differently from the conventional Fresnel prisms, insure a higher efficiency and a greater deviation of the light beam. It is also possible to provide a combination of conventional prisms or cylindrical microlenses at the centre of the device with TIR prisms at the periphery of the device.

In a further variant, two crossed array of microlenses are provided on both opposite faces.

According to a further variant, the array of cylindrical microlenses or microprisms on the screen may be replaced by a suitable shape of the reflector element.

BRIEF DESCRIPTION OF THE DRAWINGS

Further features and advantages of the invention will become apparent from the description which follows with reference to the annexed drawings, given purely by way of non-limiting example, in which.

DETAILED DESCRIPTION OF THE INVENTION

Figure 1:
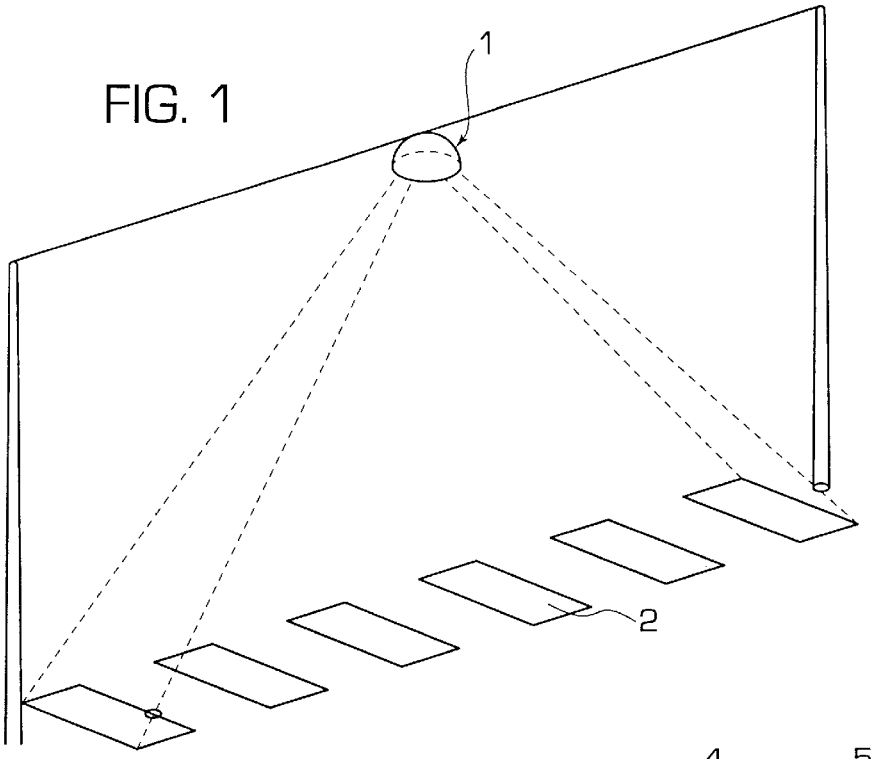
FIG. 1 is a diagrammatic perspective view which shows the application of a lighting device according to the invention for the illumination of pedestrian crossings.

In FIG. 1, reference numeral 1 generally designates a device for illuminating pedestrian crossings 2 which is supported by any known supporting means at a height of about 5–7 meters above the ground.

Figure 2:
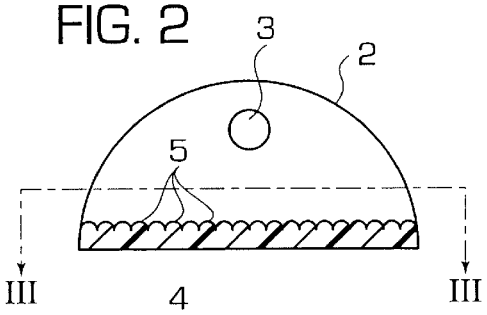
FIG. 2 is a cross-sectional view and at an enlarged scale of the device shown in FIG. 1.
Figure 3:
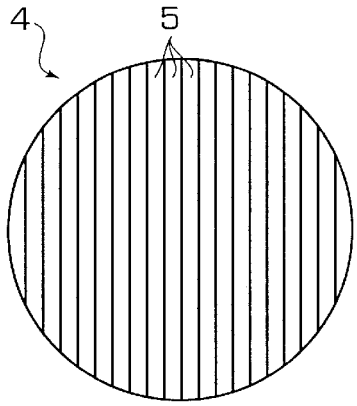
FIG. 3 is a cross-sectional view taken along line III—III of FIG. 2.

With reference to FIGS. 2, 3, the device 1 has a reflecting parabola 2 which reflects the light rays emitted by a light source 3, constituted by a lamp of any type, towards the work area. The light rays reflected by the parabola 2 pass through a planar screen 4 having either one or both opposite faces having an array of cylindrical microlenses 5 (see also FIG. 3) which generate a light beam which forms a rectangular pattern on the ground whose divergence is defined by the "F number" of the microlenses in one direction, and by the shape of the reflector in the other direction.

Figure 5A:
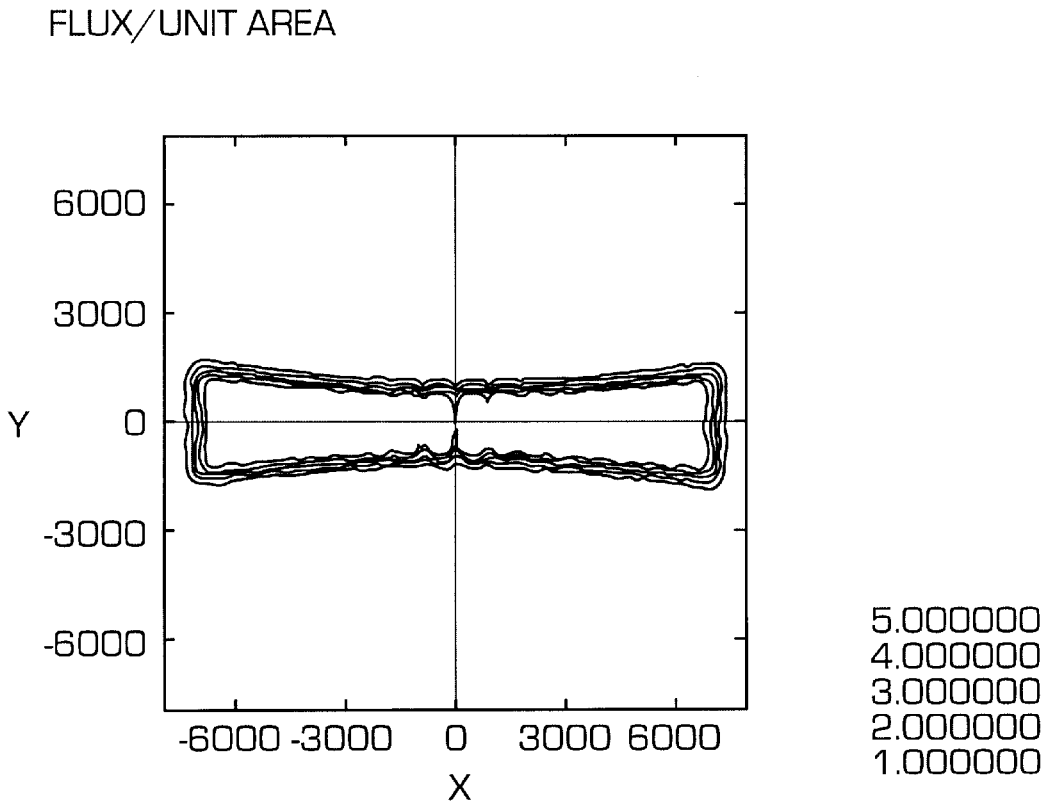

In an embodiment which has been worked out by the Applicant, the parabola 2 had an outer diameter of 100 millimetres and a depth of 39.5 millimetres and had an aluminium coating with a 0.97 reflectance. The cylindrical microlenses 5 had an "F number" close to 1.2. The cylindrical microlenses 5 were arranged with a pitch of 0.2 millimetres. However, in order to obtain a good uniformity of the light beam at the work plane, pitches between 0.1 millimetres and 0.5 millimetres are also acceptable. The pitch of 0.2 millimetres insures the uniformity without introducing the technological complications which would be associated to the pitch of 0.1 millimetres. A pitch (period) greater than 0.5 millimetres would involve a reduction of uniformity of the beam, but would still be applicable. The curvature of the microlenses was directed towards the inside of the parabola because in this manner the reflections within the lens are reduced and the pattern becomes more defined. By this embodiment an overall efficiency was measured of about 75%. The Isolux curve distribution on the ground is shown in the diagram of FIG. 5*a*, where the numbers represent the distances from the optical axis of the parabola in millimetres. By this type of solution beams with a divergence along the X direction between 10° and 120° in total were obtained.

Figure 4:
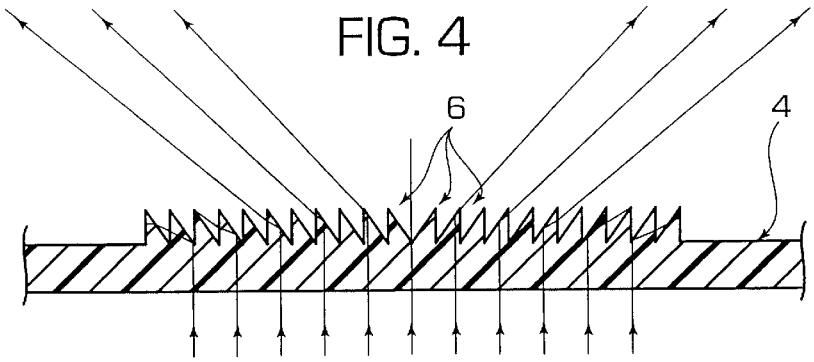
FIGS. 4, 4*a* shows two variants of a detail of FIG. 2, FIGS. 5*a*, 5*b* show two patterns at the work area which can be obtained by the device according to the invention.
Figure 4A:
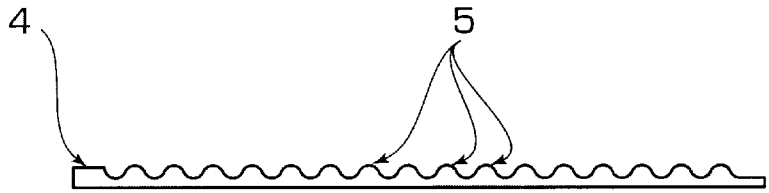

FIG. 4*a* shows a variant in which the array of cylindrical microlenses is replaced by an array of microlenses, still having a cylindrical symmetry but with a substantially sinusoidal profile, optimized in order to ensure an uniform illumination all over the rectangle.

FIG. 4 shows a variant in which the array of cylindrical microlenses 5 is replaced by an array of microprisms 6, which in this case is provided on the outer surface of screen 4. The prisms 6 are of the total inner reflection type. FIG. 4 shows a case in which the prisms are arranged uniformly and symmetrically with respect to the centre of the device. By this type of total inner reflection microprisms, the measured efficiency is greater than 80% and the overall divergence of the beam along the direction X orthogonal to the main direction of the prism may reach values greater than 120°.

Figure 6:
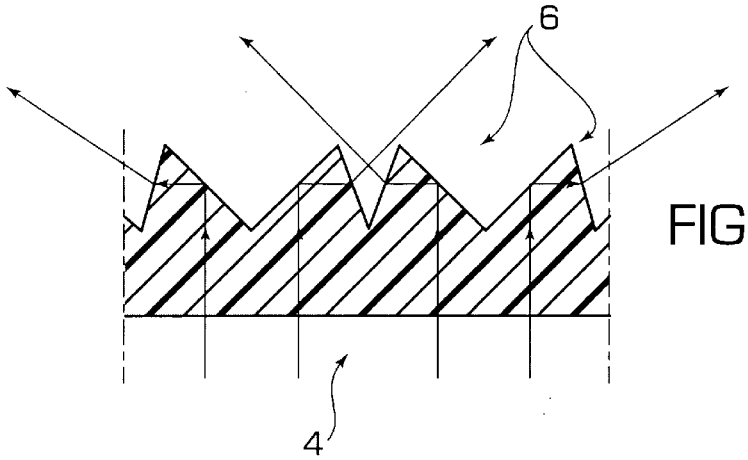
FIGS. 6, 7 show two further variants of FIG. 4.
Figure 7:
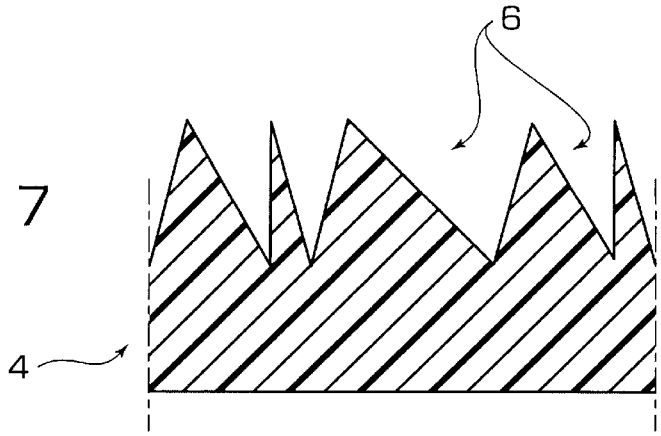

FIG. 6 shows a variant in which the prisms have different angles in order to insure the uniformity of the beam at the work plane. It is also possible to provide an array of total inner reflection prisms according to a matrix, or also to provide an array of prisms with a variable pitch, as shown in FIG. 7.

In a further variant of the device the microlenses are provided on both opposite surfaces; by this type of solution a larger divergence along the orthogonal direction Y up to 90° is achieved.

Figure 5B:
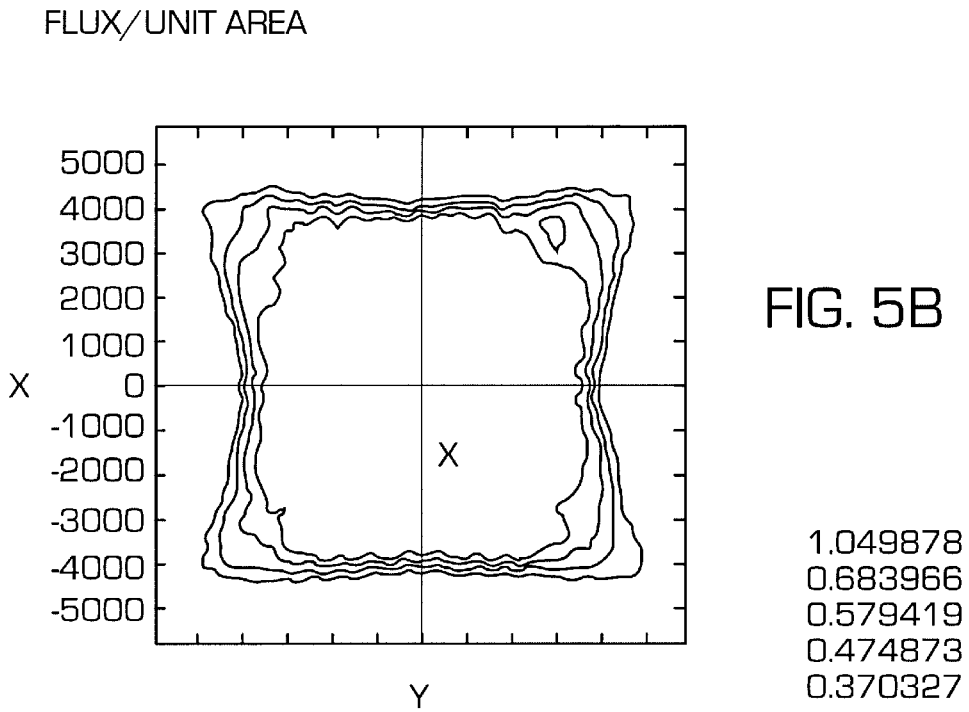

A typical pattern at the work area which can be obtained by the device according to this variant is shown in FIG. 5*b*

Finally, it is possible to provide a combination of conventional prisms which operate by refraction at the centre of the lens and prisms which operate by total inner reflection at the periphery.

A further embodiment of the device comprises a reflector with a complex shape such that at least 9/10 of the overall flow is reflected by the reflector and directed according to the required pattern. The transparent lens located in front of the reflector in this case has no prisms, but is provided with a curvature or, alternatively, is planar. In general, the transparent element, be it with prisms, microlenses or with a smooth surface, will be of glass material with acrylic, polycarbonate or other type of plastic material which is resistant also to high temperatures, such as the polyarilate, in relation to the type of light source which is used.

Naturally, while the principle of the invention remains the same, the details of construction and the embodiments may widely vary with respect to what has been described and illustrated purely by way of example, without departing from the scope of the present invention.

What is claimed:

1. A lighting device for generating a light beam to form a defined and uniform rectangular pattern which is highly divergent in one direction and has a reduced divergence in an orthogonal direction, said lighting device comprising:

a light source, a parabolic reflector element for reflecting the light rays emitted by the light source toward the area to be illuminated, a planar screen having two opposite surfaces located in front of the parabolic reflector and having an array comprised of at least one of cylindrical microlenses and microprisms on one of the two opposite surfaces, and wherein said screen has an array of microprisms which are at least in part of total inner reflection microprisms in order to improve transfer efficiency and to increase the divergence of the light beam up to angles greater than 120°.

2. A lighting device as set forth in claim 1, wherein the array of microprisms has a uniform pitch.

3. A lighting device as set forth in claim 1, wherein the array of microprisms has a variable pitch.

* * * * *